United States Patent [19]

Kofahl

[11] Patent Number: 4,502,535

[45] Date of Patent: Mar. 5, 1985

[54] JET ENGINE PUMP AND DOWNHOLE HEATER

[76] Inventor: William M. Kofahl, Rte. 2, Box 297, Licking, Mo. 65542

[21] Appl. No.: 526,616

[22] Filed: Aug. 26, 1983

Related U.S. Application Data

[63] Continuation of Ser. No. 264,864, May 18, 1981, Pat. No. 4,401,159.

[51] Int. Cl.[3] ..... E21B 43/00; E21B 36/02

[52] U.S. Cl. ..... 166/105; 166/59; 166/62; 417/364

[58] Field of Search ..... 166/59, 62, 68, 105–107, 166/108–112; 417/364; 175/11, 12, 14, 93

[56] References Cited

U.S. PATENT DOCUMENTS

| | | | |
|---|---|---|---|
| 2,432,079 | 12/1947 | Albert | 166/62 |
| 2,444,754 | 7/1948 | Steffen | 166/62 |
| 2,849,958 | 9/1958 | Mitchell | 417/364 |
| 2,902,270 | 9/1959 | Salomonsson et al. | 166/59 X |
| 3,004,603 | 3/1958 | Rogers et al. | 166/59 |
| 3,083,779 | 4/1963 | Rowley | 175/93 X |
| 3,216,498 | 11/1965 | Palm | 166/59 X |
| 3,606,999 | 9/1971 | Lawless | 166/59 X |
| 4,201,524 | 5/1980 | Wilkins | 417/364 |
| 4,285,401 | 8/1981 | Erickson | 166/53 X |

*Primary Examiner*—Stephen J. Novosad
*Assistant Examiner*—Michael Starinsky
*Attorney, Agent, or Firm*—Jerry W. Mills; Gregory M. Howison; Nina L. Medlock

[57] ABSTRACT

A pumping system (10) is disclosed for pumping a fluid (14) from within a borehole (12) to the surface. A combustion engine (18) is employed to drive a pump comprising a pump barrel (28) and an auger pump shaft (32). The pumped fluid is carried from the borehole in a fluid return tubing string (42) having a standing valve (44) therein to prevent backflow into the borehole. A fuel-air mixture is provided to the combustion engine (18) through a fuel-air tubing string (22). A byproduct of the combustion of the fuel-air mixture is heat. The combusted mixture is exhausted from the combustion engine (18) through an engine exhaust tubing string (60). The engine exhaust tubing string includes a heating coil portion (64) forming a heat exchanger to transfer heat from the combusted fuel-air mixture to the fluid (14) adjacent the inlet of the pump to reduce the viscosity of the fluid to enhance the efficiency of the pumping system.

2 Claims, 1 Drawing Figure

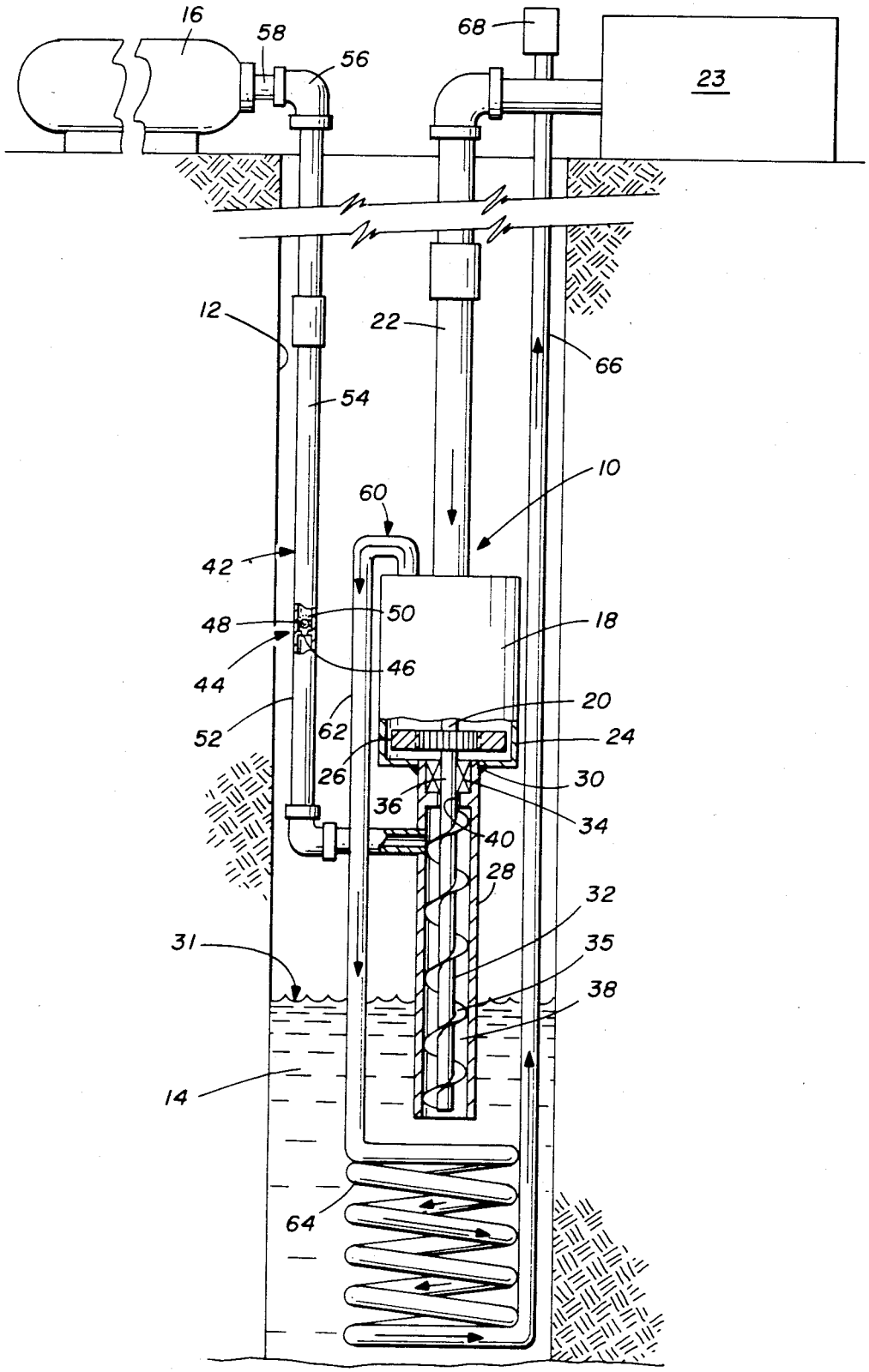
16
58
56
68
23
12
22
66
54
10
60
42
48
50
18
44
46
52
62
20
24
26
30
36
34
40
28
32
31
35
38
14
64

JET ENGINE PUMP AND DOWNHOLE HEATER

CROSS-REFERENCE TO RELATED APPLICATIONS

This is a continuation application of Ser. No. 264,864, filed on May 18, 1981, now U.S. Pat. No. 4,401,159.

TECHNICAL FIELD

This invention relates to the pumping of fluids from one elevation to a higher second elevation, in particular, the invention relates to the pumping of oil from a borehole.

BACKGROUND ART

Recovery of oil and other precious fluids from the ground typically involves the drilling of a borehole to the depth necessary to reach the reservoir or pocket of oil. The drilling equipment is then removed and the borehole is lined with a casing to prevent collapse.

In the past, pumping units have been positioned on the surface adjacent the borehole for vertically reciprocating a string of sucker rods extending to a pump within the borehole. This type of pumping unit requires considerable space on the surface. In addition, the pumping unit must be aligned with the pump within the borehole so that pumping efficiency is not adversely affected and the sucker rod string and pump are not injured by the misalignment.

In many situations, the oil or fluid to be pumped to the surface has a viscosity so high that conventional pumping techniques are not effective. Some efforts have been made to heat oil within a borehole to reduce the viscosity of the oil to permit pumping by conventional techniques. These heating techniques have been independent of the pumping techniques and therefore require additional, complex and expensive equipment.

Therefore, a need has been shown to develop a pumping unit for cost effective and reliable pumping of a fluid which may operate on fluids having a wide range of viscosity.

DISCLOSURE OF THE INVENTION

In accordance with the present invention, a pump system for pumping fluid from a first elevation to a higher second elevation is provided. The pump includes a combustion engine for combustion of a fuel-air mixture. Pump structure is provided which is operable to draw fluid from the first elevation into a inlet and force the fluid drawn into the inlet through an outlet with sufficient energy to drive the fluid to the second elevation. The pump structure is operated by the combustion engine upon combustion of the fuel-air mixture therein. Structure is provided for supplying the combustion engine with the air-fuel mixture for combustion. A combustion exhaust tubing string is provided for carrying the combusted fuel-air mixture from the combustion engine. The combustion exhaust tubing string includes a heating coil positioned adjacent the fluid at the first elevation for heating the fluid to be pumped to reduce the viscosity thereof.

In accordance with another aspect of the present invention a pump system is provided for pumping fluid from a borehole which includes a combustion engine for rotating a drive shaft upon combustion of a fuel-air mixture. The combustion engine is adapted for placement within the borehole. A pump having an inlet and outlet is provided. The pump is operable to draw fluid from the borehole into the inlet and force fluid out of the outlet, the rotation of the shaft of the combustion engine operating the pump. A return tubing string extends from the outlet for carrying the fluid to the surface, the tubing string has a standing valve therein separating the tubing string into upper and lower sections. The standing valve permits fluid flow only from the lower to upper section. A fuel-air mixture tubing string is provided for extension into the borehole to supply the combustion engine with fuel-air mixture for combustion. A combustion exhaust tubing string is provided for carrying the combusted fuel-air mixture from the combustion engine out of the borehole. The combustion engine tubing string has a heating coil therein for heating the fluid in the borehole with the combusted fuel-air mixture to reduce the viscosity thereof.

BRIEF DESCRIPTION OF THE DRAWINGS

A more complete understanding of the invention may be had by reference to the following Detailed Description when taken in conjunction with the accompanying Drawing, wherein:

FIG. 1 is a vertical cross-section view of a pumping system forming one embodiment of the present invention.

DETAILED DESCRIPTION

Referring now to the Drawing, wherein like reference characters designate like or corresponding parts throughout several views, FIG. 1 illustrates a pumping system 10 forming one embodiment of the present invention. The pumping system 10 may be supported within a borehole 12 for pumping the fluid 14 from within the borehole to the surface for storage in a tank 16.

The pumping system 10 includes a combustion engine 18 supported within a borehole. In the preferred embodiment, the combustion engine 18 comprises a jet turbine engine such as found on small jet aircraft. The combustion engine combusts a fuel-air mixture to provide the energy for rotating a drive shaft 20. The combustion engine 18 may be supported within the borehole by a fuel-air mixture tubing string 22 extending from the surface. The fuel-air tubing string also performs the function of providing the fuel-air mixture under pressure to the combustion engine for combustion from supply 23.

The drive shaft 20 enters a gear casing 24 having a speed reduction gear assembly 26 mounted therein. The gear casing 24 may be integral with the housing of engine 18. The drive shaft 20 is secured to one of the gears in the gear assembly 26 forming the high speed input.

A pump barrel 28 is secured to the gear housing 24 as by weld 30. The opposite end of the pump barrel 28 is open and is preferably under the surface 31 of the fluid 14 within borehole 12 when the pump system is properly positioned within the borehole. An auger cam or Archimedes screw-type pump shaft 32 is rotatably mounted within the pump barrel 28 by bearings 34. The auger pump shaft 32 includes a drive section 36 which enters the gear assembly 26 and forms the slow speed rotation output. The rotation of the drive shaft 20 at a relatively high rotational velocity rotates the auger pump shaft 32 with a greatly reduced rotational velocity. The pump shaft has a lower screw portion 35 for lifting fluids upon rotation thereof.

When the lower ends of both the pump barrel 28 and auger pump shaft 32 are positioned beneath the surface 31 of the fluid, rotation of the pump shaft 32 forces fluid upward in the annular section 38 between the pump shaft and pump barrel. Seals 40 are provided adjacent the bearings 34 to prevent fluid from entering the bearings and gear assembly. The pump barrel 28 includes an aperture near its upper end for connection to a fluid return tubing string 42 extending from the pump barrel to the surface. The rotation of the pump shaft 32 urges the fluid into the tubing string 42 and upward toward the surface. A standing valve 44 may be provided within the tubing string 42. The standing valve 44 includes an orifice 46, a ball 48 for sealing engagement with the orifice and cage 50 to maintain the ball 48 in close proximity with the orifice. The standing valve 44 divides the tubing string 42 into a lower section 52 and an upper section 54. The standing valve 44 permits fluid flow only from the lower section to the upper section. Therefore, should the pump system 10 cease operation, the fluid 14 in the upper section 54 of the tubing string 42 will not flow back into the borehole.

A connector 56 is secured at the upper end of the tubing string 42 and is further connected to a storage line 58. The storage line 58 extends into the storage tank 16 for storing the fluid pumped from the borehole.

The combusted fuel-air mixture is discharged from engine 18 through an engine exhaust tubing string 60. The tubing string 60 includes a downwell casing portion 62 extending downward into the borehole from the combustion engine. The downwell casing portion 62 extends to a heating coil portion 64 positioned adjacent the open end of the pump barrel 28. The heating coil portion 62 includes a number of turns of tubing as shown in FIG. 1 which provides effective heat transfer from the combusted mixture within the tubing to the surrounding fluid 14. An upwell casing portion 66 extends from the opposite end of the heating coil portion 64 upward to the surface. The cooled combusted fuel-air mixture is then exhausted to the atmosphere through muffler 68.

The pumping system 10 is therefore operable to pump fluid 14 out of a borehole 12. In addition, the combusted fuel-air mixture at elevated temperatures is employed through the heating coil portion 64 to heat the fluid 14 surrounding the entrance of the pump barrel 28 to reduce the viscosity of the fluid 14 to reduce the energy necessary to pump the fluid to the surface.

In one proposed construction of the pumping system 10, a jet aircraft engine is employed as the combustion engine 18. The combusted fuel-air mixture exhausted from the aircraft engine will have a temperature about 2100° F.

In the embodiment described above, the engine 18 and pump are supported in the borehole. The engine 18 can be put at the surface adjacent the borehole if desired. The pump may also be positioned at the surface by modifying the pump to extend from the surface to the fluid 14 to be pumped.

Although a single embodiment of the invention has been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. A pump system for pumping fluid from a first elevation at the bottom of a bore hole to a higher, second elevation at the top of the bore hole, comprising:

a pump disposed within the bore hole;

a jet turbine engine disposed within the bore hole for driving said pump;

means for supporting said jet turbine engine and said pump within the bore hole, said supporting means providing a means for powering said jet turbine engine by supplying a fuel-air mixture thereto from a source at the top of the bore hole and also for removing the exhaust therefrom, said fuel-air mixture pressurized; and means attached to said pump for removing the fluid pumped by said pump to the top of the bore hole at the second elevation thereof.

2. The apparatus of claim 1 wherein said means for supporting comprises a tubing string for carrying said fuel-air mixture to said jet turbine engine.

* * * * *